US005843240A

United States Patent [19]

Pedrazzini et al.

[11] Patent Number: 5,843,240

[45] Date of Patent: Dec. 1, 1998

[54] PROCESS FOR STAINLESS STEEL PICKLING AND PASSIVATION WITHOUT USING NITRIC ACID

[75] Inventors: Cesare Pedrazzini, Milano; Paolo Giordani, Crema, both of Italy

[73] Assignee: Novamax ITB S.r.L., Milano, Italy

[21] Appl. No.: 733,650

[22] Filed: Oct. 17, 1996

[30] Foreign Application Priority Data

Oct. 18, 1995 [IT] Italy ..... MI95A2140

[51] Int. Cl.[6] ..... C23G 5/02

[52] U.S. Cl. ..... 134/3; 134/2; 134/4; 134/6; 134/19; 134/26; 134/28; 134/34; 134/41; 510/101; 510/109; 510/245; 510/363; 510/367; 510/375; 510/379; 510/380; 510/381; 510/401

[58] Field of Search ..... 134/2–4, 6, 19, 134/26, 28, 34, 41; 510/101, 109, 245, 363, 367, 375, 379–381, 401; 148/95, 194, 240, 243, 272, 276, 277, 284

[56] References Cited

U.S. PATENT DOCUMENTS 2,564,549 8/1951 Stargardter ..... 134/3

FOREIGN PATENT DOCUMENTS 0 188 975 A1 7/1986 European Pat. Off. .
0 236 354 B1 9/1987 European Pat. Off. .
0 505 606 A1 9/1992 European Pat. Off. .
0 582 121 A1 2/1994 European Pat. Off. .
0 626 469 A1 11/1994 European Pat. Off. .
2 551 465 A3 3/1985 France .
2 587 369 3/1987 France .
3937438 8/1990 Germany .
55-018552 2/1980 Japan .
55-050468 4/1980 Japan .
58-110682 7/1983 Japan .
8001911 10/1981 Sweden .
8305648 4/1985 Sweden .
2 000 196 1/1979 United Kingdom .
WO 91/05079 4/1991 WIPO .
WO 93/04216 3/1993 WIPO .

*Primary Examiner*—Ardin H. Marschel
*Attorney, Agent, or Firm*—Finnegan, Henderson, Farabow, Garrett & Dunner, L.L.P.

[57] ABSTRACT

Process for stainless steel pickling consisting in placing the material to be treated in a bath kept at a temperature ranging from 30° C. to 70° C. and containing:

a) $H_2SO_4$ b) $Fe^{3+}$ c) HF d) emulsifiers, wetting agents, polishing agents, acid attack inhibitors;

the bath being kept under agitation with:

an air flow and continuously fed with a quantity of oxidizing agent adjusted to the bath redox potential to be kept at 250 mV min.

7 Claims, 3 Drawing Sheets

PROCESS FOR STAINLESS STEEL PICKLING AND PASSIVATION WITHOUT USING NITRIC ACID

TECHNICAL FIELD

As it is known when, during the manufacturing process, iron and steel industry products undergo hot-rolling or intermediates undergo heat treatment, such as for instance annealing, the material is coated with a thinner or thicker oxidation layer. In consideration of the final products having to exhibit a polished and glossy finish, the oxidation layer is to be removed entirely. This is done through the well-known pickling processes generally using mineral inorganic acids, such as hydrochloric acid, sulphuric acid, nitric acid, and hydrofluoric acid, either individually or as mixtures.

According to the industrial processes currently applied, stainless steel pickling is normally almost exclusively based on the use of a nitric-hydrofluoric acid mixture, the respective acid concentrations depending on the type of plant. on the type of steel to be pickled, on the steel surface properties and on the shape of the manufacture to be treated. Although the process is undoubtedly economic and leads to excellent results, it involves extremely serious ecological problems hard to solve, brought about by the use of nitric acid. Actually, while on the one hand highly polluting nitrogen oxide vapours having general formula $NO_x$, aggressive toward metallic and non-metallic materials with which they come into contact, are vented to the atmosphere, on the other hand high nitrate concentrations are reached in wash water and spent baths, both types of pollutants requiring treatment prior to disposal. The removal of $NO_x$ from air and of nitrates from baths involves huge plant operation problems and high operating costs, with no certainty about the obtainment of targets complying with the regulations in force. This means that the resulting industrial plant investment costs can be hardly borne in most cases. A pickling method not requiring the use of nitric acid is therefore demanded by industry and various proposals in this sense have been made worldwide mainly in these last ten years.

PRIOR ART

A critical examination both of patents covering methods alternative to the traditional stainless steel pickling process based on the use of $HNO_3$+HF, no longer containing nitric acid, and of the main relating technical literature has demonstrated the following:

A) Japanese patents JP 55018552 published on 8th Feb., 1980 and JP 55050468 published on 12th Apr., 1980 provide for three steps:
   (1) initial descaling in sulphuric or hydrochloric acid,
   (2) immersion, in the former case, in a potassium permanganate and inorganic acids (non HF) solution, in the latter case, in a ferric nitrate, ferric sulphate and peroxydisulphuric acid solution,
   (3) pressure water or ultrasonic final washing.

B) Swedish patent SE 8001911 published on 12th Oct., 1981 relates to a treatment in a sulphuric acid and hydrogen peroxide solution; treatment time range: from 1 to 120 minutes (preferred range: 1–20'); temperature range: from 10° C. to 90° C. (preferred range: 30°–60° C.).

C) German patent DE 3937438 published on 30th Aug., 1990 mainly applies to the wire treatment industry and provides for the use of a hydrofluoric acid solution containing $Fe^{3+}$ fed as additive in the form of fluoride complex. Then, the solution is fed with a gas and/or an oxygenated fluid means, subjected to electrolysis to obtain nascent oxygen capable of oxidizing iron from bivalent to trivalent.

D) TOKAI Denka Kogyo's English patent 2,000,196 provides for the use of a pickling bath consisting of ferric sulphate and hydrofluoric acid. Sulphuric acid and hydrogen peroxide are added continuously in a 1:1 molar ratio, for the purpose of keeping an adequate ferric ion concentration. The patent claims the pickling treatment control method by continuous checking of the redox potential to be kept at ≧300 mV by controlled $H_2SO_4$+$H_2O_2$ feeding.

E) Two much alike European patents, EP 188975 and EP 236354 (=WO 87/01739), the respective priority dates whereof are 22nd Jan., 1985 and 19th Sep., 1985, provide for the use of a pickling solution consisting of hydrofluoric acid (5–50 g/l) and trivalent ferric ion added as fluoridated complexes, continuously blown into with air or oxygen; treatment time range: 30" to 5'; temperature range: 10° C. to 70° C.; continuous checking is recommended for redox potential, which should be kept at −200 to +800 mV, in the case of the former patent, and at +100 to +300 mV, in the case of the latter patent; if the potential requires to be raised, an oxidizer such as potassium permanganate or hydrogen peroxide should be added. All pickling tests were conducted on sheets only.

Finally, there are two further patents regarding the possibility of avoiding or minimizing the formation of nitrogen oxides $NO_X$ in baths using nitric acid, by the direct addition of suitable oxidizers to the pickling bath: the former, Japanese patent JP 58110682 dated 1st Jul., 1983, provides for the use of hydrogen peroxide; the latter, Swedish patent SE 8305648 dated 15th Apr., 1985—priority date 14th Oct., 1983, SE 835648—provides for the use of hydrogen peroxide and/or, as an alternative, of urea.

Nevertheless, despite this proliferation of patents, the traditional process based on the use of nitric and hydrofluoric acid is still massively applied all over the world and none of the alternatives proposed thus far and outlined above is being applied in industry. A remarkable advance has been made with the pickling process disclosed in Applicant's European patent 582,121, which provides for the use of a $H_2SO_4$+HF bath containing $Fe^{3+}$ and $Fe^{2+}$ ions and operating at controlled redox potential. The reoxidation of $Fe^{2+}$ ion to ferric ions is obtained by periodical additions of $H_2O_2$ to the pickling solution.

SUMMARY OF THE INVENTION

The process which is the subject of the present patent application is a technically valid and, in many respects, economic alternative to the aforementioned procedures. In particular, it is a valuable integration of Applicant's patent EP 582,121.

The process is based on the use of a pickling bath containing iron ions, $H_2SO_4$, HF, and conventional additives, such as wetting agents, emulsifiers, polishing agents, inhibitors of acid attack, continuously or periodically fed with an oxidizing agent capable of converting the $Fe^{2+}$ that forms during pickling to $Fe^{3+}$, while the pickling solution redox potential is maintained at the preset value. The oxidizing agent may be selected among the following classes of compounds:

a) oxidized chlorine acids: the alkaline salts thereof, such as NaClO, $NaClO_2$, $NaClO_3$;

b) peroxidized acids, in particular persulphuric acid salts;

c) soluble permanganates.

Advantageous oxidising agents are those of item a) in particular NaClO owing to their low cost.

All aforesaid oxidizing agents may be fed to the bath as such or as an aqueous solution.

DETAILED DESCRIPTION OF THE INVENTION

The operating temperature normally ranges from 30° C. to 70° C., its value depending to a large extent on the type of steel and on the type of plant, in which connection it is of basic importance that the possibility of performing mechanical descaling upstream of chemical pickling be secured. The basic process features are described hereinafter.

It is very important to agitate the pickling bath continuously to renew the pickling solution in contact with the metal surface to be treated. A very effective method consists in the continuous blowing of a strong air flow into the bath.

Content of Inorganic Mineral Acids in the Bath

Several are the functions of sulphuric and hydrofluoric acids: among the most important, those of maintaining process pH below 2.5 and of removing the oxides due to heat treatment from the steel surface. Hydrofluoric acid is meant to complex $Fe^{3+}$ and $Cr^{3+}$ ions as much as possible and to depassivate the oxidized material, bringing the electrode potential to an active and/or active/passive dissolution field (see hereinafter). In the absence of hydrofluoric acid, the operating potential rises to the material steady passivity field and descaling practically does not take place. Besides contributing to the total and free acidity of the solution, sulphuric acid exerts a passivating effect similar to the one exerted by nitric acid. Since, in the course of pickling, the contents of the two acids, mainly of hydrofluoric acid, tend to reduce, periodical feeding of same has to be performed as a function of the results of bath analysis (determination of free acidity and fluoride ions). The acids concentration under normal operating conditions varies, depending on the treated material, from 5 to 50 g/l for hydrofluoric acid and from 30 to 150 g/l for sulphuric acid. The pH of a pickling solution as it is (without dilution), measured by neutral pH Crison 2002 with ingold electrode, at room temperature is generally lower than 2.5.

$Fe^{3+}$ ion content in the bath: the pickling solution contains an amount of $Fe^{3+}$ ions not below 15 g/l and preferably equal at least to 30 g/l, initially added as ferric sulphate: the function of such ion is of replacing—as oxidizer—nitric acid, according to the reaction $2Fe^{3+}+Fe \rightarrow 3Fe^{2+}$, favoured by the bath pH conditions. During the process, proper conditions must continuously be secured to allow the iron dissolved in the bath to be partially present as $Fe^{3+}$. The oxidation of $Fe^{2+}$ to $Fe^{3+}$ ions during the process to keep the latter concentration above the minimum preset value is secured by continuous oxidizer feeding, adjusted to the redox potential value, which is measured either constantly or periodically. The pickling bath is generally prepared with an initial oxidizer quantity to secure, also in the process start-up phase, an adequate redox potential value, adjusted to the type of steel to be pickled, to the surface properties of the manufacture (or semimanufactured product), as well as to the quantity and quality of hot-rolling or annealing scales.

The addition of oxidizer during the process cycle is substantially adjusted to the preset bath oxidation potential, which is thus kept at the preset value. Pickling processes of stainless steel often imply the final passivation of the pickled material. Said treatment may be carried out in a bath of composition similar to the pickling bath composition, but with redox potential adjusted to higher values. The baths using the oxidizers of class b) and class c) best suit said procedure.

Continuous Air Blowing

During pickling, a continuous air flow is kept in the bath, in the order of 3 $m^3/m^3$ bath per pickling hour min. The air flow, admitted at a proper and constant rate, favours bath agitation, a major condition for good pickling. Actually, agitation continuously perturbs the liminal layer of the bath, near the surface to be treated, which is thus continuously kept in direct contact with an ever renewed pickling solution. Air blowing into from the vessel bottom, through drilled pipes or proper blowing items, secures excellent mechanical agitation and pickling liquid homogenization. Instead of air blowing, other means may be conveniently used to favour pickling bath agitation and secure a perfect homogenization of same and a continuous renewal of the solution in contact with the metal surface to be pickled, i.e. means setting the liquid bath in quick motion (supersonic waves, liquid forced-circulation) or conveying the liquid as jets or sprays to the surface to be treated.

Redox potential control: as is known, stainless steel behaviour in acid mixtures is characterized by polarization curves, which exhibit activity, passivity and transpassivity phases depending on the redox potential value (see FIG. 1).

Legend of FIG. 1

$EO_2EH_2$ equilibrium potentials of O and H development reactions

Ep critical passivation potential

Epc complete passivation potential

Eo free corrosion or null (external) current potential $E_M$ equilibrium potential of alloy anodic dissolution reaction $E_T$ transpassivation potential Legend of FIG. 2

Chromium content influence on polarization curve: current density (abscissa versus the critical passivation potential (ordinate).

a) sufficent Cr b) less than sufficient Cr c) completely insufficient Cr

Legend of FIG. 3

Polarization curve of ozidized Cr steel a) basic alloy peak b) dechromized alloy peak

BRIEF DESCRIPTION OF THE FIGURES

The typical curve of FIG. 1 applies, however, to steel of uniform composition and, mainly, with a chromium content sufficient to bring about passivability (Cr>12%). A lower chromium content modifies the polarization curve as shown by FIG. 2, namely it reduces the passivity field, while increasing the passivity current density and raising the critical passivation potential. Since, under the scale formed by the hot-rolling or annealing oxide layer, a stainless steel type, such as the one which the pickling method of the invention refers to, always exhibits a thinner or thicker layer of dechromized alloy, i.e. poorer in chromium than its basic composition, the steel polarization curve always shows the trend indicated in FIG. 3, where the dechromized alloy peak is more or less clearly evident.

To make sure that a real descaling and a thorough removal of the dechromized alloy take place during pickling, with the restoration of max. surface passivity, the bath has to be placed under potentiostatic control conditions. This means that the operating redox potential has to be adjusted so that during the true pickling step it may remain in the range where the dechromized alloy anodic dissolution rate is the highest when compared with that of the basic alloy (hatched area, FIG. 3). It is possible to preset the said range as a function of the steel type, while guaranteeing basic metallic material passivation, after dechromized alloy removal.

Figure 1:
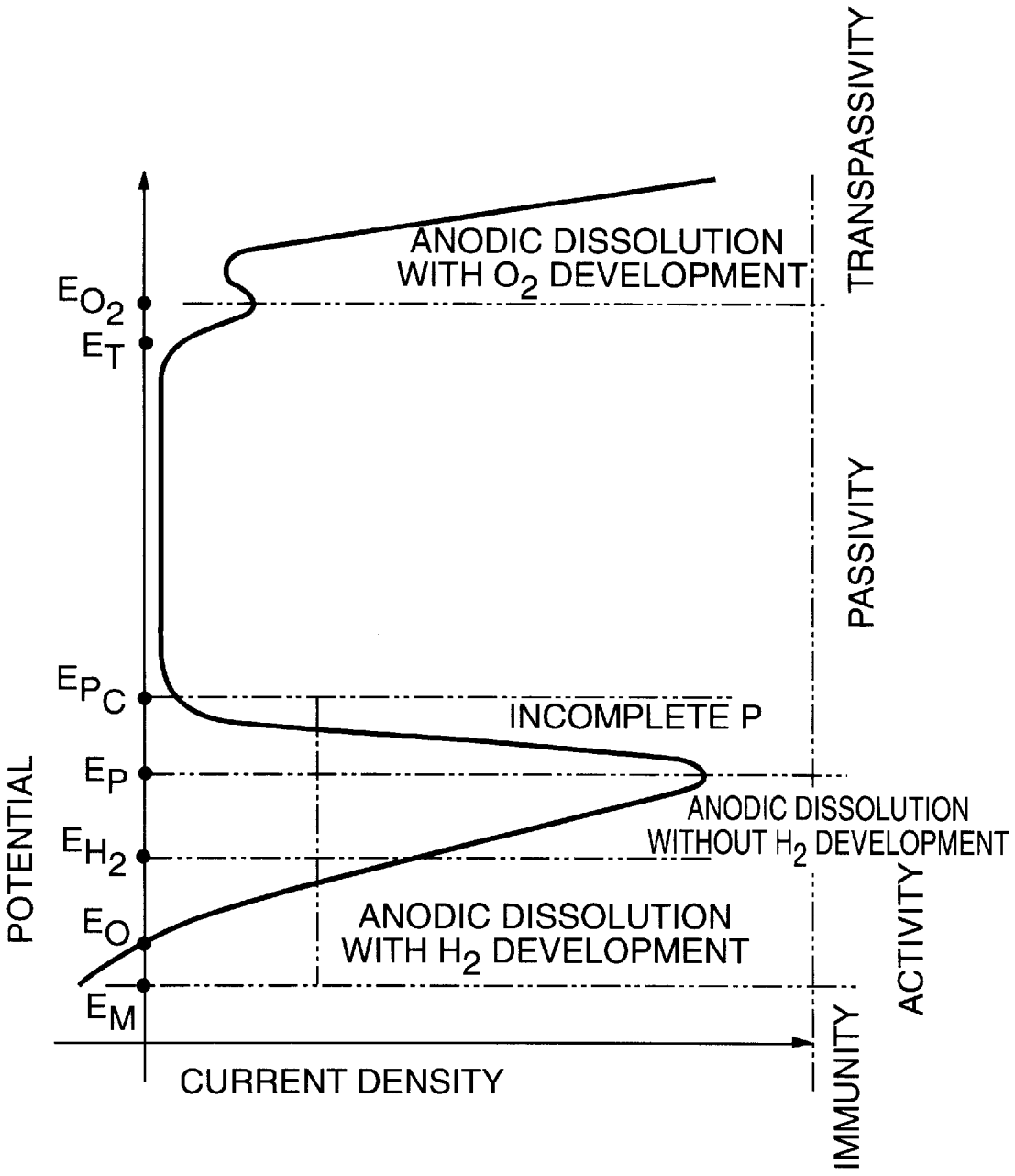
Figure 2:
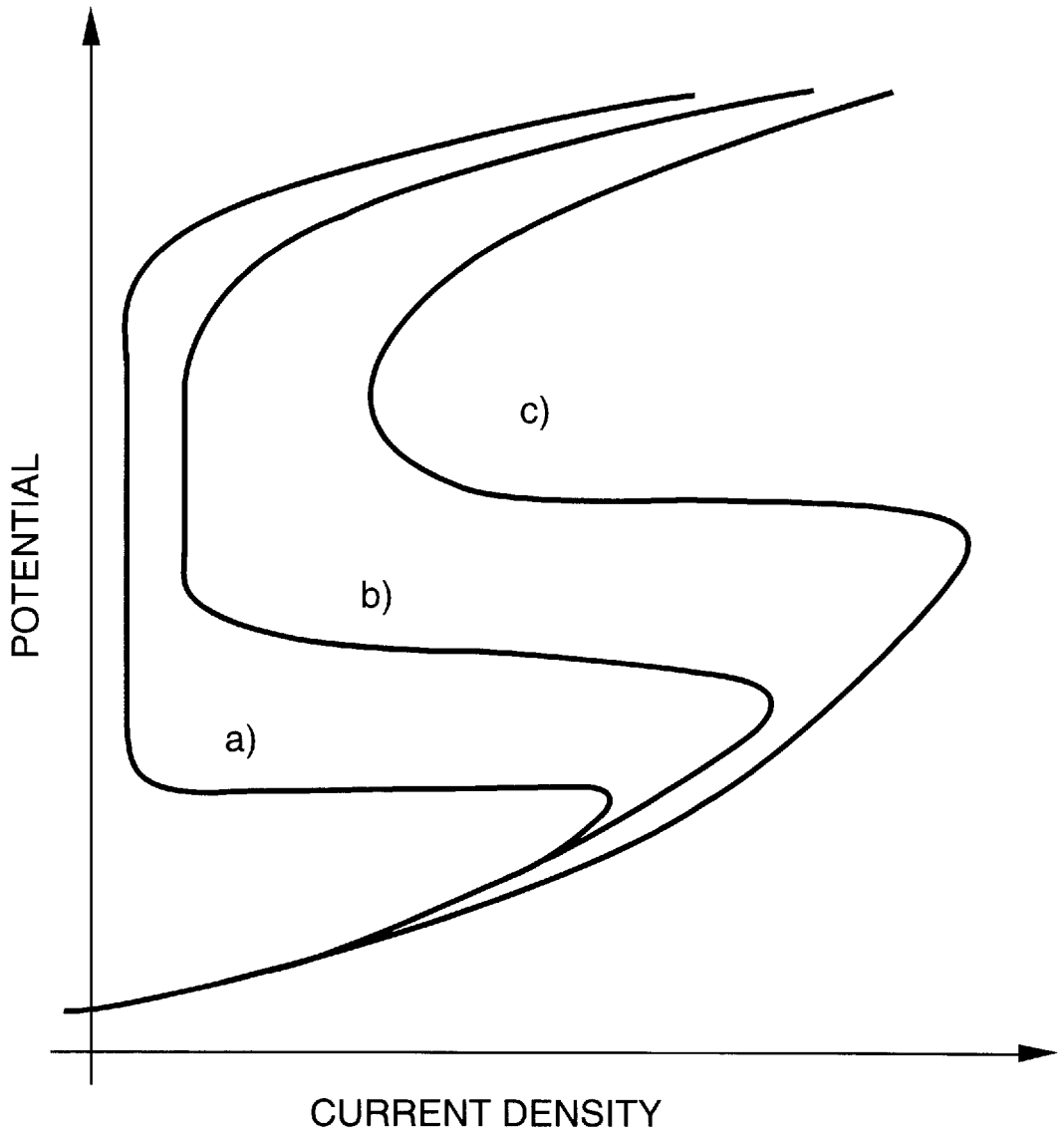
Figure 3:
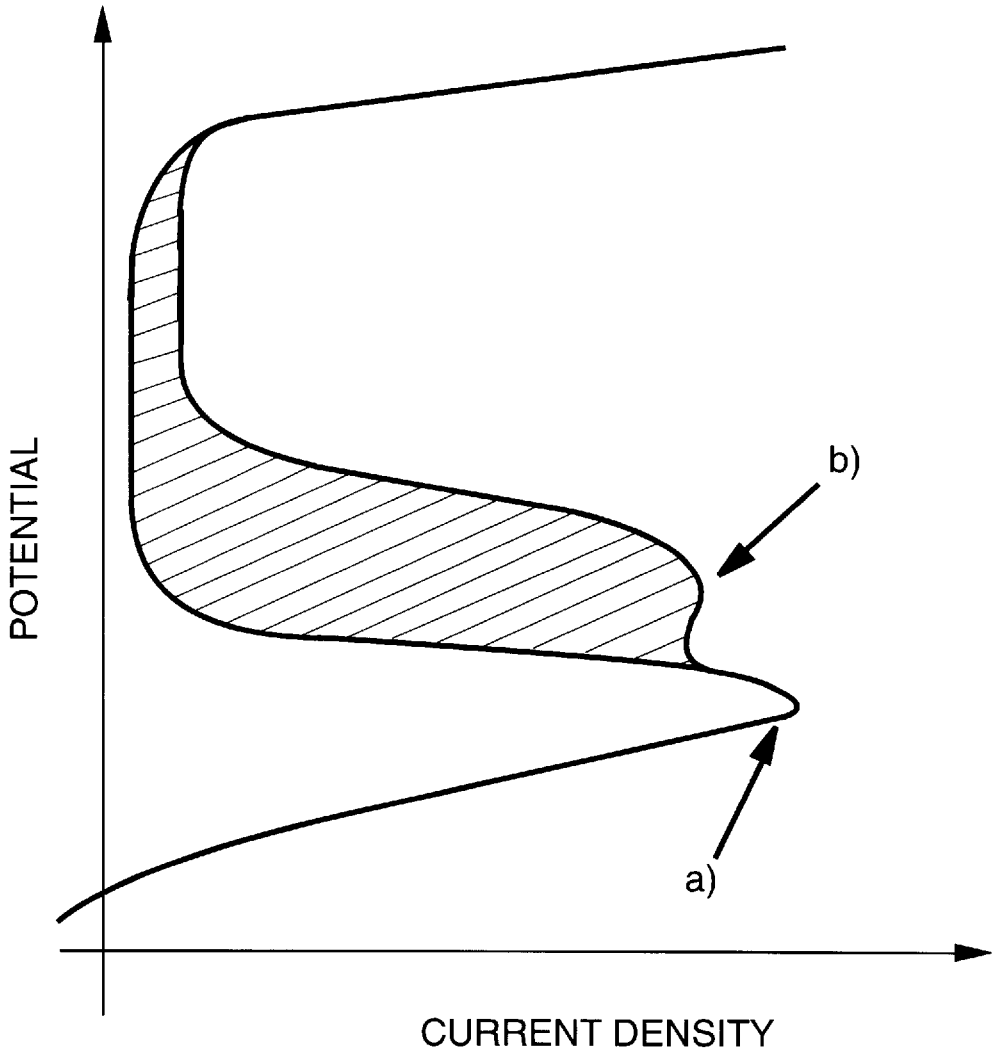

During pickling, as the bivalent iron ion concentration in the bath rises, the bath redox potential tends to lower, but the addition of oxidizer allows to maintain said potential at optimal values, normally higher than 300 mV. In the applied processes the value of 700 mV is never exceeded.

Wishing to obtain material pickling and subsequent passivation in the same bath, the redox potential is to be kept at 350 mV min. In case of any particular upstream steel treatment and if a subsequent passivation stage in a separate bath is envisaged, the pickling bath potential may be kept at lower values, anyway not below 200 mV. The pickling solution redox potential is measured with a platinum electrode and a reference electrode, e.g. calomel or Ag/AgCl type. A constant potential control, therefore, secures not only good steel pickling, but also the formation of a passivity film thereon.

Commercial-scale tests have, in fact, demonstrated the possibility of obtaining polished, bright, and perfectly even surfaces, free from any corrosion phenomenon due, for instance, to pitting, material "burning" or an excessive pickling action.

Additives Content in the Pickling Bath

When preparing the pickling bath according to the present invention, the normal additives used, in a total amount of approx. 1 g/l bath, are non-ionic surfactants acting as wetting agents, emulsifiers, polishing agents, and acid attack inhibitors. Thanks to a synergic action, these additives improve pickling by favouring it.

Particularly advantageous additives are perfluorinated anionic surfactants as well as non-ionic surfactants belonging to the alkoxylated alcohols derivatives class.

An efficient inhibitor guarantees basic metal protection, reduces losses drastically, and results highly effective mainly in the case of batch processes requiring long pickling time (rods, pipes, bars).

The additives present in the bath, particularly acid attack inhibitors, do not inhibit the attack against oxides caused by heat treatment, hence they do not absolutely limit pickling kinetics, as shown e.g. by the results of tests conducted on AISI 304 shot-peened sheet steel.

Advantages of the Process

Absence of mud: the process according to the invention minimizes or even prevents the formation of mud and sludge, with a consequent clearcut further saving.

Such an advantage is also due to an appropriate HF concentration during the process cycle, as well as to a control of the concentration of ferrous ions, readily and suitably oxidized to ferric ions.

Differently from the mud and sludge produced by traditional baths using nitric and hydrofluoric acids, the mud and sludge produced to a greatly smaller extent by the process bath of the invention are a greenish slush, friable and incoherent in the dry state, with no tendency to packing and lumping into large crystals and therefore easy to remove.

Automatic control possibility: the process according to the invention can always be kept under control by automatic means, which—through analytical determinations (free acids content, iron ion content, redox potential)—continuously meter the amounts of pickling materials and of oxidizer necessary to secure correct operating parameters.

Process versatility: the process according to the invention suits any existing commercial plant handling stainless steel as the required adjustments are quite modest. Furthermore, it is appropriate for the treatment of manufactures and semimanufactured products of any type whatever, from wire to rod, from belts to sheets and pipes, thanks to operating parameters (temperature, times, concentrations) being changeable to no detriment of results.

A typical example of such a versatility is represented by the continuous application of the process of the invention to steel rolling units: by merely changing the working potential, the process can, in fact, be used both during the sole pickling stage (in the case of hot-rolled steel), when only descaling and dechromized surface layer removal are required, and during the stages when steel is to be given final passivation too (in the case of cold-rolled steel).

The following examples are being conveyed for the sole purpose of illustrating the possible applications of the process according to the invention.

EXAMPLE 1

A first continuous pickling plant handled continuous sheets from hot-rolling units, consisting of austenitic steel or martensitic steel or ferritic steel.

Pickling process conditions were, therefore, a function of the type of steel to be treated and of its physical state, namely if steel had undergone mechanical descaling or not. Moreover, since the units were meant for hot-rolling, the primary object of pickling was descaling and dechromized alloy removal, rather than final steel passivation.

Thus, pickling process conditions were as per the following tables:

TABLE a

| Austenitic steel, series 300 - shot-peened | |
|---|---|
| Temperature, °C. | <60 |
| $H_2SO_4$, g/l | 100–130 |
| $Fe^{3+}$, g/l | 30–60 |
| Free $F^-$, g/l | 25–35 |
| E redox, mV | 300–340 |
| Treatment time | 2' to 3' |

TABLE b

| Austenitic steel, series 300 - non-shot-peened | |
|---|---|
| Temperature, °C. | 60–70 |
| $H_2SO_4$, g/l | 120–140 |
| $Fe^{3+}$, g/l | 40–60 |
| Free $F^-$, g/l | 30–40 |
| E redox, mV | >320 |
| Treatment time | 2' to 3' |

TABLE c

| Ferritic or martensitic steel, series 400 - shot-peened | | |
|---|---|---|
| | 1st vessel | 2nd vessel (passivation) |
| Temperature, °C. | >50 | ambient |
| $H_2SO_4$, g/l | 50–120* | 30–50 |
| $Fe^{3+}$, g/l | 30–50 | 2–7 |
| Free $F^-$, g/l | 15–20** | <5 |
| E redox, mV | 250–300 | >600 |
| Treatment time | 60" to 90" | 60" to 90" |

*AISI 409, 15–20
**AISI 409, 10–20

Air was forced continuously into the two vessels, at a rate of 10 $m^3/m^3$ bath/h, along with a continuous feeding of sodium persulphate so as to keep the redox potential at the preset value. Persulphate average consumption was ca. 7 kg/t material treated.

The sulphuric and hydrofluoric acids consumed in the process were made up by periodical additions of same so as to maintain the preset concentrations. The pickling solutions also contained additives of known type belonging to the class of non-ionic surfactants and acid attack inhibitors, commonly used in pickling baths (polyethoxylated alcohols, fluorinated surfactants) in a total quantity in the order of 1 g/l.

EXAMPLE 2

Continuous sheets from cold-rolling units, i.e. sheets of steel series 300 and series 400, were treated according to a pickling procedure consisting of the following steps:

a) electrolytic pickling with $H_2SO_4$ in the 1st vessel; treatment time 1'; temperature range from 60° C. to 70° C.;

b) pickling with a bath according to the invention in two consecutive vessels (i.e. 2nd and 3rd vessels); treatment time in each vessel: 1';

the pickling solutions composition and characteristics are shown in the Tables reported hereinafter.

The working capacity of each vessel (i.e. 2nd and 3rd vessels) was 17 $m^3$.

During treatment, air was forced continuously into the 2nd and 3rd vessels, at a rate of 70 $m^3/m^3/h$, along with a continuous feeding of oxidizer consisting of $NaClO_3$ as an aqueous solution and of the other ingredients ($H_2SO_4$ and HF), so as to keep concentrations constant at the preset values.

TABLE a'

| Austenitic steel, series 300 - shot-peened | 2nd vessel | 3rd vessel |
|---|---|---|
| Temperature, °C. | 60–65 | 60–65 |
| $H_2SO_4$, g/l | 100–150 | 100–150 |
| $Fe^{3+}$, g/l | 20–60 | 15–50 |
| Free $F^-$, g/l | 20–30 | 20–30 |
| E redox, mV | >280 | >350 |

TABLE b'

| Austenitic steel, series 300 - non-shot-peened | 2nd vessel | 3rd vessel |
|---|---|---|
| Temperature, °C. | 60–65 | 60–65 |
| $H_2SO_4$, g/l | 100–150 | 100–150 |
| $Fe^{3+}$, g/l | 20–60 | 15–50 |
| Free $F^-$, g/l | 30–40 | 20–30 |
| E redox, mV | >280 | >350 |

TABLE c'

| Austenitic steel, series 400 - shot-peened | 2nd vessel | 3rd vessel |
|---|---|---|
| Temperature, °C. | 50–60 | ambient |
| $H_2SO_4$, g/l | 100–150 | 0–10 |

TABLE c'-continued

| Austenitic steel, series 400 - shot-peened | 2nd vessel | 3rd vessel |
|---|---|---|
| $Fe^{3+}$, g/l | 30–80 | 0–10 |
| Free $F^-$, g/l | 20–30 | 2–10 |
| E redox, mV | >250 | 500–600 |

The superficial aspect of sheets at the end of the pickling process cycle always resulted to be polished and bright, even better than secured by the traditional process ($HF+HNO_3$).

In this case too, no overpickling or superficial corrosion phenomenon was recorded.

$NaClO_3$ consumption was 0.78 kg/t treated steel.

EXAMPLE 3

Commercial Plant for Rod Production

Steel in the form of austenitic (AISI 303, AISI 304), ferritic and martensitic (AISI 416, AISI 420) stainless steel rods and profiles was treated in a commercial plant.

Austenitic steel was treated in the sole rolled form, while martensitic steel and ferritic steel were treated also in the semimachined or raw sandblasted form.

Pickling according to the process of the invention was carried out in six Moplen-lined vessels, each having a capacity of 8–9 $m^3$.

Pickling conditions for austenitic steel were as per Table 3; those for martensitic steel and ferritic steel were as per Table 4. In both cases, treatment times were a function of the quantity and quality of the removable oxides due to heat treatment, at the outlet of the annealing surface.

When leaving the pickling bath, steel was subjected to thorough washing with water under pressure.

TABLE 3

| Pickling of austenitic steel (series 300) | |
|---|---|
| Temperature | 30–35° C. |
| Treatment time | AISI 303 = 60'–120'<br>AISI 304 = 40'–50'<br>AISI 316 40'–50' |
| Bath preparation | 150 g/l $H_2SO_4$<br>50 g/l HF<br>15 g/l $Fe^{3+}$<br>air = continuous blowing |

TABLE 4

| Pickling of martensitic steel and ferritic steel (series 400) | |
|---|---|
| Temperature | 30–35° C. |
| Semimachined steel | Pickling in a bath kept with a controlled free acidity decidedly lower than required by series 300.<br>Treatment time: 30'–60'. |
| Raw sandblasted steel | Pickling in two steps:<br>A) sulphuric acid bath, for superficial black fine dust removal.<br>Treatment time: 15' to 20'.<br>B) pickling bath as in the case of series 300.<br>Treatment time: 3'–10'. |

Potassium persulphate in aqueous solution was used as oxidizer.

Additives consisted of non-ionic surfactants as well as acid attack inhibitors of known types for pickling baths (perfluorinated complexes and ethoxylated alcohols).

Bath feeding consisted in the continuous addition of oxidizer in the quantity of 1 g/l of bath per pickling hour plus, from time to time, $H_2SO_4$, HF and the abovementioned additives, depending on the results of analytical tests.

The continuous air blowing rate was approx. 30 $m^3$/h into each vessel. Pickling kinetics resulted to be comparable with, sometimes even higher than, those secured by the traditional process based on the use of nitric and hydrofluoric acids, formerly used in the plant.

The redox potential was kept steadily over 300 mV (preferably between 350 and 450 mV), which resulted in an excellent surface finish of the treated steel.

Total iron content, at the time of bath replacement, would be approx. 100 g/l, $Fe^{3+}$ and $Fe^{2+}$ accounting respectively for 60 g/l and 40 g/l. In no case materials showed superficial corrosive attack or "burning" phenomena.

Precipitate formation was absolutely negligible and no ferrous sulphate or fluorinated complexes crystallization occurred. Potassium persulphate consumption resulted to be 7 kg/t treated material.

We claim:

1. Pickling process for chromium containing stainless steel comprising:

placing the material to be treated in a bath kept at a temperature ranging from 30° C. to 70° C., said bath having the following optimal composition:

(a) $H_2SO_4$ from 30 to 150 g/l (b) $Fe^{3+}$ at least 15 g/l (c) HF from 5 to 50 g/l (d) additives (emulsifiers, wetting agents, polishing agents) and acid attack inhibitors: approximately 1 g/l;

keeping said bath under agitation by a continuous air flow or equivalent agitation means, feeding quantities of ingredients (a), (c), and (d) to said bath for maintaining said optimal composition in the bath and a bath pH not higher than 2.5, and an oxidizing agent quantity suitable for maintaining the bath redox potential at values of at least 200 mV, said oxidizing agent being selected from oxidized chlorine acids and salts thereof, peroxidized acids, such as persulphuric acid and salts thereof, alkaline permanganates.

2. The process according to claim 1 wherein at least one of hypochlorous acid, chlorous acid, chloric acid, and alkaline salts thereof is used as oxidizing agent.

3. The process according to claim 1, wherein the pickling bath is adjusted to an oxidation potential of at least 350 mV, to insure passivation of the material to be treated.

4. The process according to claim 1, wherein the pickling bath is continuously fed with an air flow equal to at least 3 $m^3$/h per $m^3$ bath, through a diffuser distributing the flow in the pickling bath.

5. The process according to claim 1, wherein $Fe^{3+}$ ions are introduced into the initial pickling bath as ferric sulphate.

6. The process according to claim 1, wherein a surfactant belonging to one of the non-ionic surfactants alkoxylated alcohol containing at least 6 C atoms, and perfluorinated anionic surfactants, is used as wetting agent, emulsifier, polishing agent, and acid attack inhibitor.

7. The process according to claim 1, further comprising a preliminary partial removal of oxides by a known mechanical method.

* * * * *